US006883411B2

(12) United States Patent
Arrasmith et al.

(10) Patent No.: US 6,883,411 B2
(45) Date of Patent: Apr. 26, 2005

(54) IMPELLER FOR ROTARY SLICING MACHINE

(75) Inventors: Paul E. Arrasmith, Valparaiso, IN (US); Brent L. Bucks, Valparaiso, IN (US)

(73) Assignee: Urschel Laboratories Incorporated, Valparaiso, IN (US)

( * ) Notice: Subject to any disclaimer, the term of this patent is extended or adjusted under 35 U.S.C. 154(b) by 0 days.

(21) Appl. No.: 09/828,953

(22) Filed: Apr. 10, 2001

(65) Prior Publication Data

US 2002/0144584 A1 Oct. 10, 2002

(51) Int. Cl.[7] ..... B26D 7/06

(52) U.S. Cl. ..... 83/403; 83/404; 83/407; 416/187

(58) Field of Search ..... 83/145, 166, 408, 83/932, 663, 403, 703, 404, 407; 416/178, 187

(56) References Cited

U.S. PATENT DOCUMENTS

| | | | | | |
|---|---|---|---|---|---|
| 2,349,212 | A | * | 5/1944 | Urschel et al. | 83/145 |
| 2,465,670 | A | | 3/1949 | Urschel et al. | |
| 2,478,651 | A | * | 8/1949 | Blachere | 99/513 |
| 2,934,117 | A | | 4/1960 | Urschel et al. | |
| 3,196,916 | A | | 7/1965 | Urschel | |
| 3,395,742 | A | | 8/1968 | Sanders | |
| 3,521,688 | A | | 7/1970 | Urschel et al. | |
| 3,871,256 | A | * | 3/1975 | Willett | 83/355 |
| 4,043,036 | A | * | 8/1977 | Stevens, Sr. et al. | 30/43.6 |
| 4,206,671 | A | | 6/1980 | Hoehn | |
| 4,590,835 | A | | 5/1986 | Matsuo | |
| 4,625,606 | A | | 12/1986 | Pinegar et al. | |
| 4,782,729 | A | * | 11/1988 | Mathot | 83/408 |
| 5,694,824 | A | * | 12/1997 | Jacko et al. | 83/403 |
| 5,722,143 | A | | 3/1998 | Bucks et al. | |
| 5,784,937 | A | * | 7/1998 | Wygal et al. | 83/422 |
| 5,827,046 | A | * | 10/1998 | Konno et al. | 416/178 |
| 6,314,849 | B1 | * | 11/2001 | Arrasmith | 83/145 |

* cited by examiner

*Primary Examiner*—Kenneth E. Peterson
*Assistant Examiner*—Omar Flores Sánchez
(74) *Attorney, Agent, or Firm*—Bacon & Thomas, PLLC

(57) ABSTRACT

An improved impeller for use in a rotary food slicing machine comprising a rear base plate and at least one forward ring secured in axial spaced parallel relation relative to the rear base plate and a plurality of circumferentially spaced planar paddles spanning the base plate and the forward ring. The paddles are each oriented to extend at an angle relative to the radius of the rear base plate and the at least one forward ring. Moreover, the end of each paddle located adjacent to the rear base plate is arranged in a partially trailing relationship relative to the end of the paddle located adjacent the at least one forward ring with respect to the intended direction of rotation of the impeller.

10 Claims, 7 Drawing Sheets

IMPELLER FOR ROTARY SLICING MACHINE

BACKGROUND OF THE INVENTION

This invention generally relates to an impeller for a rotary slicing machine for cutting food products and the like into slices. More particularly, this invention relates to an impeller for a rotary slicing machine, wherein the impeller has angled paddles that are arranged to transport, align and centrifugally throw out a food product in a radial direction within a drum type slicing machine so as to be cut by a fixed slicing blade mounted adjacent to the path of motion of the impeller and food product.

Food slicing machines of various types are used to cut, slice, dice and otherwise reduce the size of larger food products into smaller pieces depending upon the configuration of various knives carried by the machine. One type of a food slicing machine is a rotary slicing machine such as shown in U.S. Pat. No. 3,521,688, granted Jul. 28, 1970 to Urschel et al.

A conventional rotary slicing machine includes an open ended, generally annular impeller that is mounted for rotation in a non-rotating drum formed by a stationary housing of the machine. The impeller is rotatably driven about an axis coincident with the cylindrical axis of the drum to centrifugally throw the food products in a radially outward direction. Since the slicing operation is continuous, the impeller paddles are constantly moving in a circular path about the interior surface of the drum so as to carry the food products past a stationary slicing blade to cut the food products into slab-like slices. The slices are immediately guided into a cross-cut assembly where they are cut into strips.

An impeller adapted for use in such a rotary slicing machine must accommodate a variety of shapes and sizes of food products, especially vegetable products. A conventional impeller is shown and described in U.S. Pat. No. 3,196,916 granted Jul. 27, 1965 to Urschel. The impeller generally comprises a rear base plate and an forward ring that is permanently secured in axially spaced parallel relation to the base plate by a plurality of generally straight, planar and circumferentially spaced paddles. The paddles extend both radially and longitudinally to provide relatively large openings which diverge radially outwardly. Pockets for carrying food products are formed between adjacent paddles. The impeller is mounted within the drum for rotational movement of the paddles about an axis coincident with the cylindrical axis of the drum such that a portion of the paddles near the peripheries of the ring and the base sweep the interior surface of the drum. The paddles are arranged so they extend generally parallel with a slicing blade carried by the housing of the rotary slicing machine.

Food products are mostly fed into the rotary impeller in an orientation generally parallel with the horizontal axis of rotation. As the food products are fed into the impeller, the food products fall into a pocket in an orientation whereby a major axis of the food products lies generally parallel with the axis of the paddle. Generally, the impeller rotates about 225° from the point at which the food products are fed into the impeller until they urged against the stationary slicing blade carried by the outer housing at the periphery of the impeller. The impeller carries food products rotationally around the drum for repeated slicing engagement with the stationary slicing blade along its major axis so that the food products are sliced into a plurality of slices. It should be noted that the conventional impeller can be arranged for rotation about either a vertical or a horizontal axis, depending on the configuration of the rotary slicing machine, and more than one slicing blade can be used.

Such rotary slicing machines are of particular use for cutting whole potatoes into a plurality of slices which are delivered to a slicing system that divides the slices into french fry strips of generally uniform cross-sectional size and shape. Usually, potatoes used in preparing french fries will generally be oblong in shape and vary in size and will have a major axis and a minor axis where the major axis is the longer of the two.

Although the conventional impeller generally works well, under certain circumstances, depending upon the raw potato size, slice thickness and other variables, it has been found that a small percentage of french fries have thin, tapered and other undesirable cuts. One reason is that the conventional impeller does not consistently register a potato with either the base plate or the ring so as to reference the potato with respect to the slicing blade and the subsequent slicing and cutting operations. Another reason is that there is a tendency for some potatoes to bounce off of the paddles upon entry into the impeller, resulting in misalignment with respect to the paddles. Furthermore, as potatoes are fed into the impeller, there is a probability that potatoes may collide with one another, resulting in disorientation and potential bruising.

The effect of potato instability and the need for indexing a potato with respect to slicing and cutting apparatuses is demonstrated when a potato is first sliced by a stationary slicing knife and then by a circular knife. After a potato slab is sliced by the slicing knife, the circular knife cuts the slab along its minor axis which results in two slab portions. When a potato is not sufficiently stabilized and indexed by an impeller, there is a tendency for one slab portion to be larger than another slab portion since the potato will arbitrarily be positioned in the pocket with respect to the slicing knife. As the smaller portion proceeds from the circular knife, there is a propensity for the smaller portion to advance slower from the circular knife. Moreover, there is a tendency for the smaller portion to rotate more than the larger portion as it leaves the circular knife due to a bevel on the circular knife blade. As a result of the slower advancement and rotation of the smaller portion, there is potential for the smaller potato portions to be cut in subsequent slicing operations which may result in short, tapered and thin cuts of undesirable proportions. There exists, therefore, a need for an improved rotary impeller that sufficiently registers one end of a food product from the impeller, and orientates, aligns and stabilizes a food product so as to be routinely positioned in a desirable alignment with a slicing apparatus carried by the rotary slicing machine.

In order to overcome defects of the conventional impeller, it is known in the art to configure an impeller to carry a potato to a slicing blade in a predetermined orientation. U.S. Pat. No. 4,625,606 discloses an impeller that includes an axially centered divider ring defining a pair of annular chambers for potato passage outwardly to the slicing knife, where larger potatoes are required to orient with their longitudinal axes extending generally radially with respect to the impeller, and generally perpendicular to the slicing knife. The impeller arrangement further includes arcuate paddles that can be installed in association with the impeller blades so as to further improve potato alignment. However, this solution serves primarily to orient a potato in a desired orientation and does not register a potato from one end with respect to the impeller.

Another proposed impeller arrangement, as disclosed in U.S. Pat. No. 4,206,671, illustrates an impeller having a series of equally spaced impeller blades radiating from a central shaft. The blades of the impeller helically curve around the shaft as they extend along the shaft to form curved, cupped sections of the blade. The curve of the blade is such that when potatoes are introduced into the impeller, the impeller blades curve away from the potatoes. In a preferred embodiment, the interior of the drum has a series of grooves formed therein to assist in aligning the food products prior to cutting. One major drawback with this impeller is the fact that due to the shape of the impeller blades, a large amount of spaced is required for the impeller. As a consequence, the housing of the rotary slicing machine must be designed accordingly, and thus existing rotary slicing machines are precluded from using such an impeller.

Yet another known variation of an impeller is illustrated in FIGS. 2–4 of the appended drawings. The impeller comprises a rear base plate 12 and a forward ring 10 permanently secured in axial spaced parallel relation to the base plate 12 by a plurality of circumferentially spaced planar paddles 14. Each paddle 14 extends inwardly generally from the peripheries of the base plate 12 and ring 10 at an oblique angle, generally $\alpha=30°$, with respect to a radial plane R1 of the base plate 12. The base plate 12 preferably is provided with a central opening 18 and the forward ring 10 defines an opening 16 for receiving products to be sliced. However, this type of impeller does not sufficiently cooperate with centrifugal forces present during the rotation of the impeller so as to urge a potato axially against the forward ring 10 or the base plate 12 to thereby index the potato to enable consistent slices to be made from the potato.

Despite the solutions provided in the prior art, there still exists the need for an improved impeller that will properly align and orientate an elongate food product so as to cooperate with centrifugal forces to engage a food product with one or more fixed blades to produce a clean, flat and non-tapered series of slices. Furthermore, there still exists the need for an improved impeller that can be adapted for use in existing rotary machines.

It is therefore an object of the invention to provide an improved impeller for use with a rotary slicing machine which will orient, align and provide the necessary centrifugal force to engage a food product with one or more fixed slicing blades so as to produce a clean, flat and non-tapered series of slices.

SUMMARY OF THE INVENTION

An impeller for a rotary slicing machine is disclosed for a food product slicing machine of the type described above. In a first embodiment, the impeller is generally annular in configuration and is intended to be rotated in a given direction about an axis of rotation within a non-rotating annular drum housing supporting one or more stationary cutting knives located near the periphery of the impeller to convey elongated food products across the one or more knives. The impeller includes a circular rear base plate and at least one forward annular ring. The base plate and forward ring have corresponding effective diameters and are axially spaced along the axis of rotation of the impeller. The base plate and the forward ring also are orientated in radial planes that intersect the axis of rotation of the impeller and have forward and rearward respective facing opposed radial surfaces. The impeller further includes a plurality of food conveying paddles that span the radial surfaces of the base plate and the forward ring. The paddles are located in circumferentially spaced and generally radially oriented relationship relative to the rear plate and the forward ring so that radially outer generally axially extending edges of the paddles are located adjacent the circumferences of the rear base plate and the forward ring. The paddles are each oriented to extend at an angle relative to a radius of the rear base plate and the forward ring such that the radially inner axially extending edge of each paddle is located in leading relationship relative to the radially outer axially extending edge of the respective paddle with respect to an intended direction of rotation of the impeller. Most significantly, the end of each paddle located adjacent to the rear base plate is arranged in a partially trailing relationship relative to the end of the paddle located adjacent the at least one forward ring with respect to the intended direction of rotation of the impeller.

The impeller may also accommodate at least one additional forward ring that is axially spaced from the forward ring wherein a second plurality of food conveying paddles span the radial surfaces of the forward ring and the additional ring. In one variation of the second embodiment, the first plurality of paddles is arranged in an aligned relationship with the second plurality of paddles. In another variation of the second embodiment, the first plurality of paddles is arranged mutually offset from the second plurality of paddles.

The orientation of the paddles with respect to the base plate and ring of the impeller of the present invention improves the alignment of food products in conjunction with the centrifugal forces generated on the food products during rotation of the impeller so that the food products are more securely positioned and held when they come into contact with the slicing blade so they do not dislodge easily. Additionally, the orientation of the paddles urges the centrifugal forces to index the food products toward the base during rotation so as to align the food products with the slicing blade, thus providing an indexing action on the food products with respect to the slicing blade and the circular blades of the slicing machine. Furthermore, the orientation of the paddles protects the food products from colliding with other food products entering the impeller so as to prevent disorientation of food products already carried by the impeller.

The combination of the base plate, forward ring and oriented paddles constituting the impeller of the present invention were found to orientate and align a variety of different sized food products to produce uniformly dimensioned slices of food products in a rotary drum by the slicing machine of the type mentioned above.

DETAILED DESCRIPTION OF THE PREFERRED EMBODIMENTS OF THE INVENTION

Figure 1:
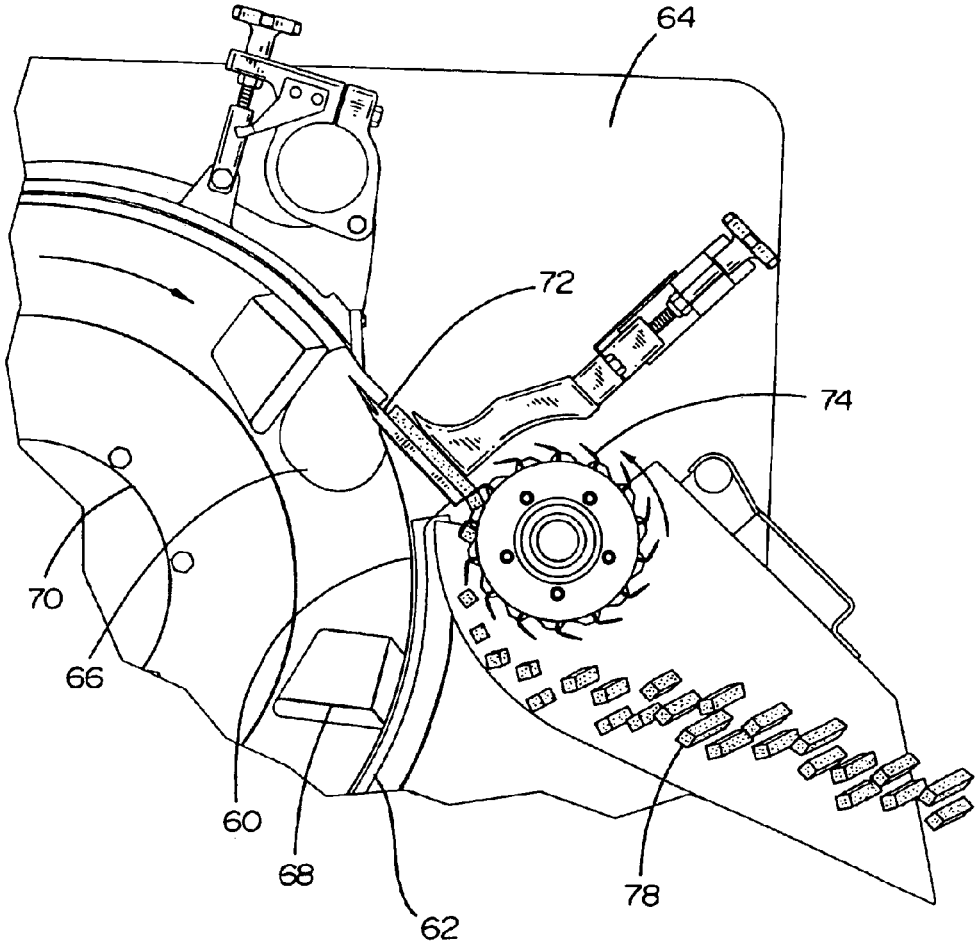
FIG. 1 is a side view of a portion of a rotary slicing machine including an impeller of the present invention.
Figure 2:
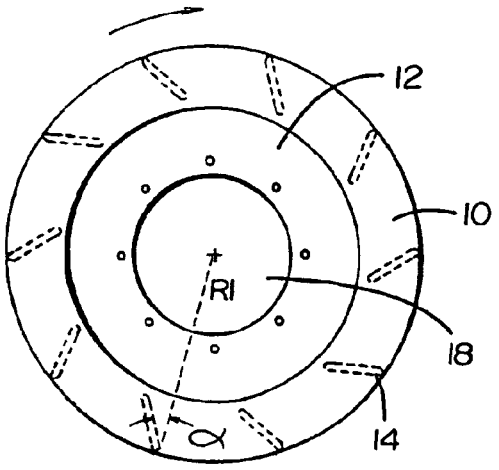
PRIOR ART FIG.2
FIG. 2 is a plan view of a standard impeller having angled paddles.
Figure 3:
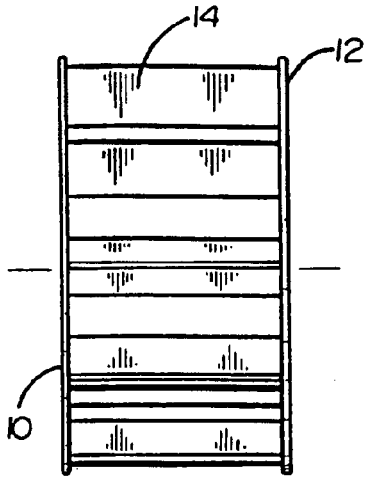
PRIOR ART FIG.3
FIG. 3 is a side elevation view of a standard impeller having angled paddles.
Figure 4:
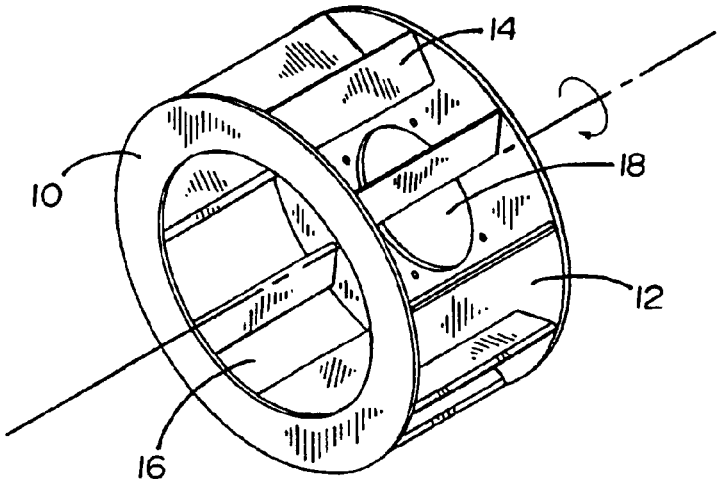
PRIOR ART FIG. 4
FIG. 4 is a perspective view of a standard impeller having angled paddles.

As illustrated in FIG. 1, a rotary slicing machine includes an open ended, impeller 70 that is mounted for rotation in a non-rotating drum 62 formed by a stationary housing 64 of the machine. The impeller 70 is rotatably driven about an axis coincident with the cylindrical axis of the drum to centrifugally throw the food products 66 in a radially outward direction. Since the slicing operation is continuous, the impeller paddles 68 are constantly moving in a circular path about the interior surface 60 of the drum. The centrifugal force holds the food products 66 against the interior surface 60 of the drum as the impeller rotates so as to carry the food products 66 past a slicing blade 72 to cut the food products into slab-like slices. The slices are immediately guided into a cross-cut assembly 74 where they are cut into strips 78.

Figure 5:
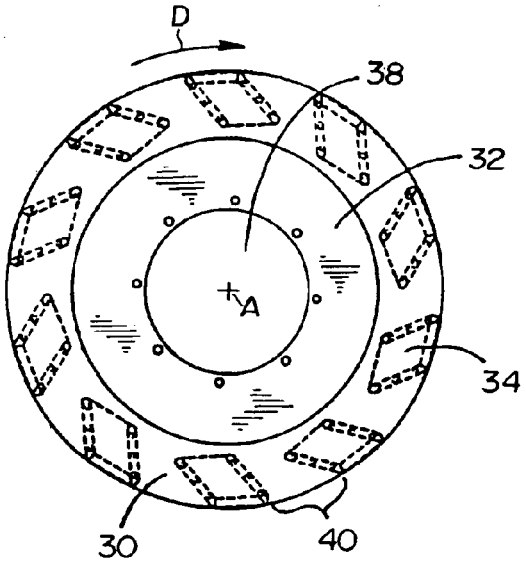
FIG. 5 is a plan view of a preferred embodiment an impeller having angled and slanted paddles according to the invention.
Figure 6:
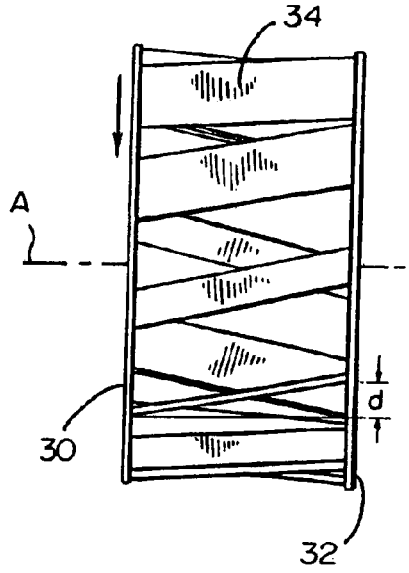
FIG. 6 is a side elevation view of the impeller having angled and slanted paddles.
Figure 7:
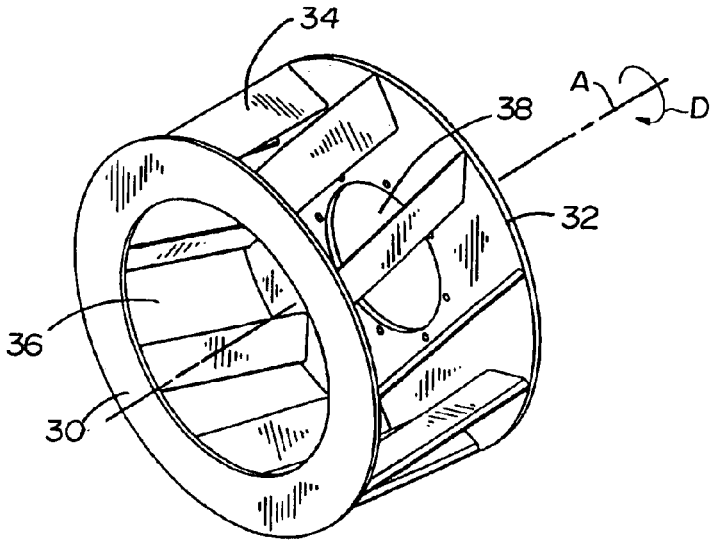
FIG. 7 is a perspective view of the impeller having angled and slanted paddles.

An embodiment of the impeller of the present invention is shown in FIGS. 5–7. The impeller includes a circular rear base plate 32 and at least one forward located annular ring 30. The base plate 32 and the forward ring 30 have corresponding effective diameters centered on rotary axis A and are axially spaced along the axis of rotation A of the impeller. The base plate 32 and the forward ring 30 also are orientated in radial planes that intersect the axis of rotation A of the impeller and have forward and rearward respective facing opposed radial surfaces. The impeller further includes a first plurality of food conveying paddles 34 that span the radial surfaces of the base plate 32 and the forward ring 30. Each of the paddles are generally rectilinear in shape and extend at an identical and constant angle relative to the axis of rotation of the impeller. The paddles 34 are located in circumferentially spaced and generally radially oriented relationship relative to the base plate 32 and the forward ring 30 so that radially outer generally axially extending edges of the paddles 34 are located adjacent the circumferences of the base plate 32 and the forward ring 30. The paddles 34 are each oriented to extend at an angle relative to a radius of the base plate 32 and the forward ring 30 such that the radially inner axially extending edge of each paddle 34 is located in leading relationship relative to the radially outer axially extending edge of the respective paddle 34 with respect to an intended direction of rotation A of the impeller. Each end of a respective paddle of the plurality of paddles 34 that is located adjacent to the base plate 32 is positioned in a partially trailing relationship relative to the end of the paddle of the plurality of paddles 34 that is located adjacent the forward ring 30 with respect to an intended direction of the rotation of the impeller.

In accordance with the primary aspect of the invention, as shown in FIG. 5, the impeller is subdivided into a plurality of pockets 40 between adjacent paddles 34. The size and number of the pockets 40, and thus the size and number of paddles 34, will depend on the product to be transported by the impeller and brought into contact with the cutting device.

Food products that are carried by the impeller during rotation in the direction D during use are caused to be generally aligned axially along the paddles 34 and urged so that one end of the food product is located against the base plate 32.

Figure 8:
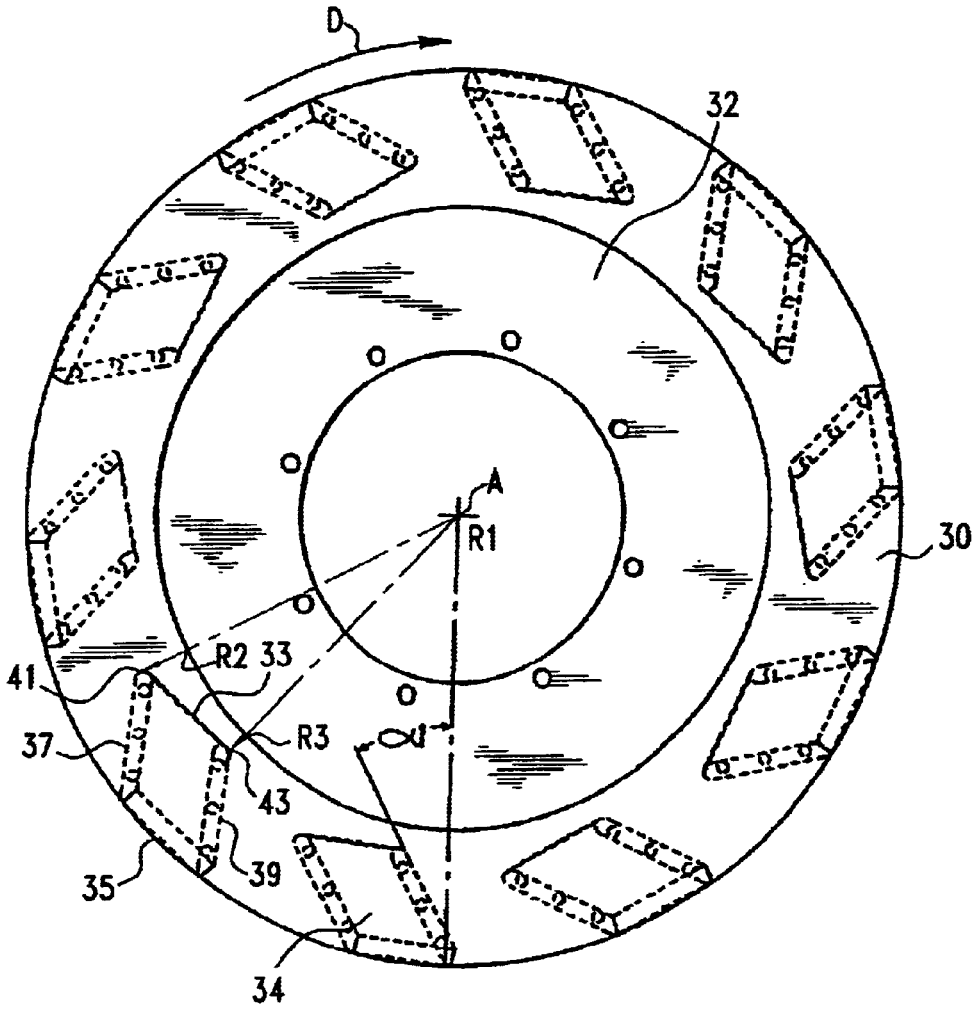
FIG. 8 is a plan view of the impeller made according to the invention showing the orientation of a paddle with respect to a radius of the impeller.

Referring to FIG. 8, in a preferred construction of the invention, each paddle 34 extends at about a 30° angle relative to the radius R1 of the base plate 32 and the forward ring 30. The paddles can extend at other angles relative to the radius R1 of the base plate 32 and the forward ring 30, and preferably are arranged within an angle range between 0° and 40. In accordance with this configuration, an inner edge 33 of each paddle 34 extends between the base plate 32 and the forward ring 30 in a leading relationship relative to an outer edge 35 of the paddle. The inner edge 33 defines a first corner 41 with a leading edge 37 and a second corner 43 with a trailing edge 39 of the paddle. A first radial distance R2 is defined between the first corner 41 and the axis of rotation A of the base plate 32 and a second radial distance R3 is defined between the second corner 43 and the axis of rotation A of the base plate 32. The first radial distance R2 is greater than the second radial distance R3.

Figure 9:
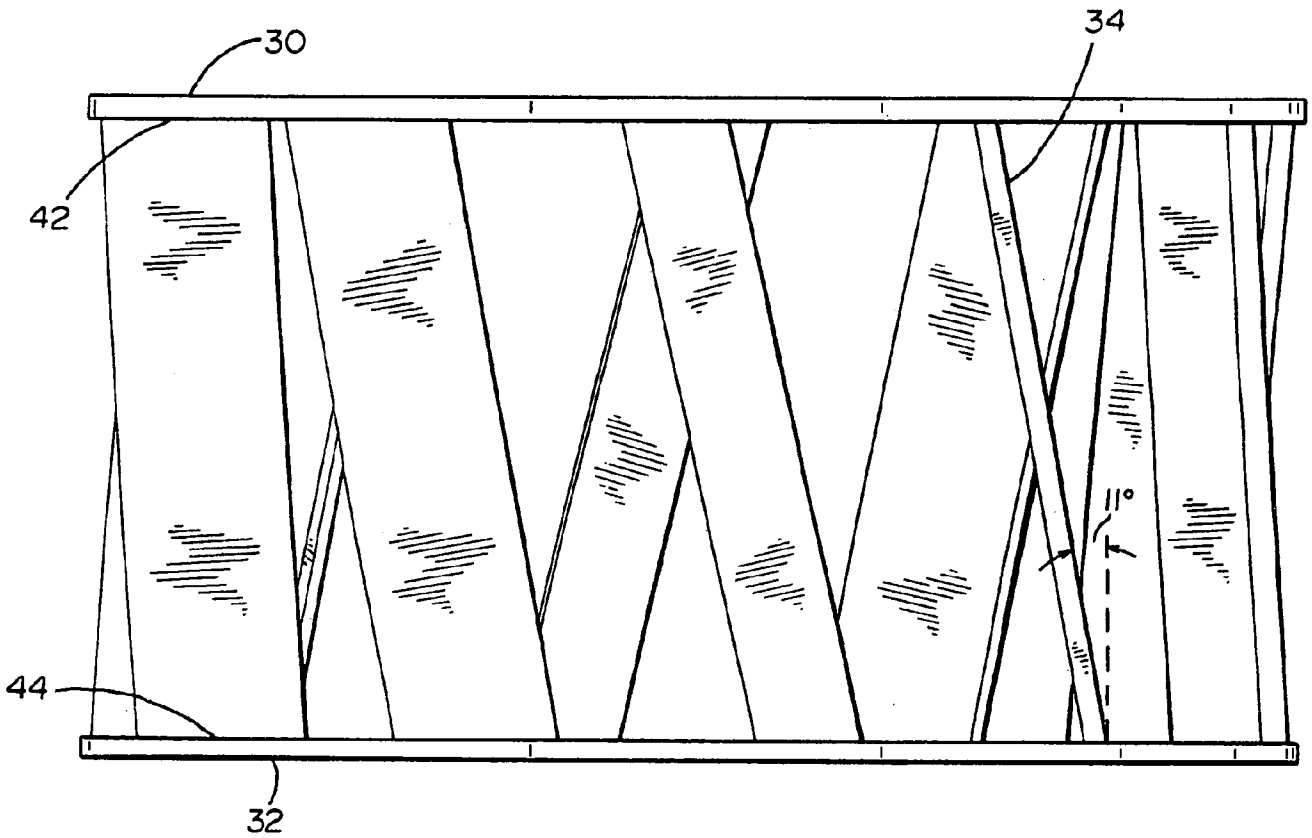
FIG. 9 is a side elevation view of the impeller of the invention showing the slant of a paddle with respect to a lower annular base of the impeller.

Referring to FIG. 9, in another preferred construction of the invention, the trailing relationship between the end of each paddle 34 adjacent to the base plate 32 and the other end of the paddle 34 adjacent to the forward ring 30 is signified by the paddle 34 extending at generally an 11° angle relative to the axis of rotation of the impeller. The paddles 34 can extend at other angles relative to the axis of rotation of the impeller and preferably are arranged within an angle range between an angle greater than 0° and less than or equal to 30°.

Figure 10:
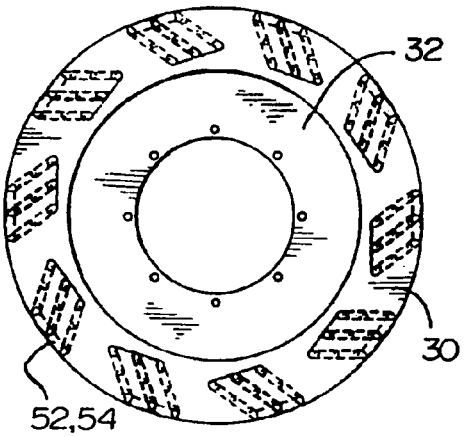
FIG. 10 is a plan view similar to FIG. 5 showing an impeller made in accordance with the invention having a central divider.
Figure 11:
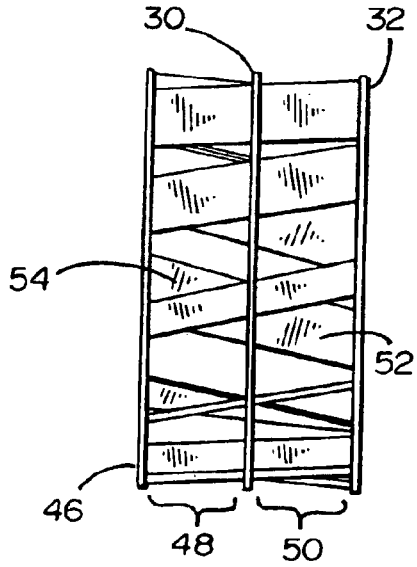
FIG. 11 is a side elevation view similar to FIG. 6 showing the impeller having a central divider.
Figure 12:
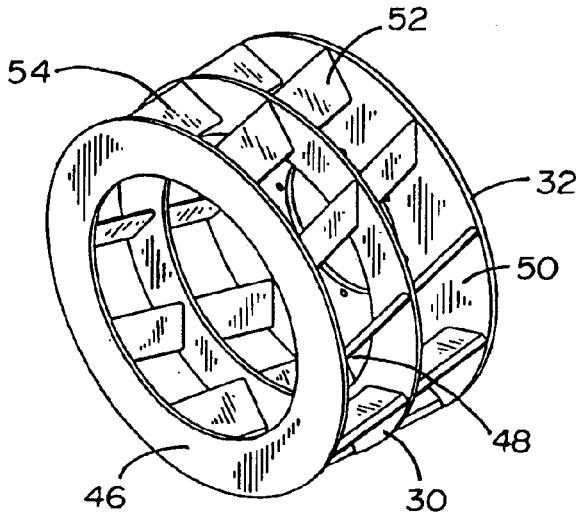
FIG. 12 is a perspective view similar to FIG. 7 showing the impeller having a central divider.

A second embodiment of the invention is illustrated in FIGS. 10–12 wherein the impeller includes an additional forward ring 46 that is axially spaced from the forward radial extending surface from the forward ring 30 in a direction opposite the direction where the rear base plate 32 is located. The additional forward ring 46 has a forward radial extending surface and a rearward extending surface. A second plurality of paddles 54 span the opposed radial surfaces of the forward ring 30 and the additional ring 46. The second plurality of paddles 54 is located in circumferentially spaced, generally radially oriented relationship relative to the forward ring 30 and the additional ring 46 so that radially outer generally axially extending edges of the second plurality of paddles 54 are located adjacent the effective circumferences of the forward ring 30. Each paddle of the second plurality of paddles 54 has radially inner axially extending edges and each paddle of the second plurality of paddles 54 terminates at an end thereof located at a radially extending surface of the forward ring 30 and the additional ring 46. Each of the paddles of the second plurality of paddles 54 is oriented to extend at an angle relative to a radius of the forward ring 30 and the additional ring 46 such that the radially inner axially extending edge of each of the second plurality of paddles 54 is located in leading relationship relative to the radially outer axially extending edge of the respective paddles with respect to an intended direction of the rotation of the impeller. Each end of a respective paddle of the second plurality of paddles 54 that is located adjacent to the forward ring 30 is positioned in a partially trailing relationship relative to the end of the paddle of the second plurality of paddles 54 that is located adjacent the additional ring 46 with respect to an intended direction of the rotation of the impeller.

In the second embodiment, elongated food products carried by the impeller during rotation and use thereof are caused to be generally axially along the paddles and urged so that one end of a food product carried by the first plurality of paddles 52 is located against the rear base plate 32 and one end of a food product carried by the second plurality of paddles 54 is located against the forward extending radial surface of the forward ring 30.

In one variation of the second embodiment, as shown in FIGS. 10–12, each paddle of the first plurality of paddles 52 is located in opposed, axially aligned relationship with a respective paddle of the second plurality of paddles 54.

Figure 13:
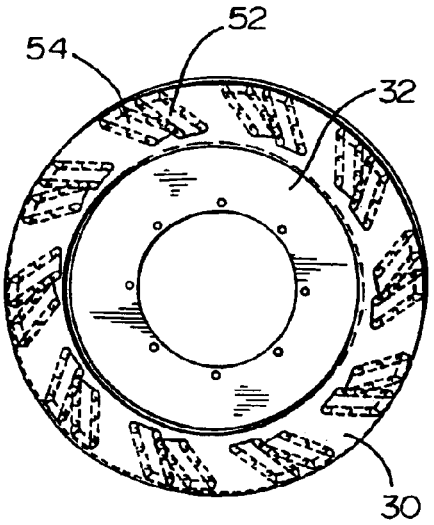
FIG. 13 is a plan view similar to FIG. 10 showing an impeller with mutually offset paddles.
Figure 14:
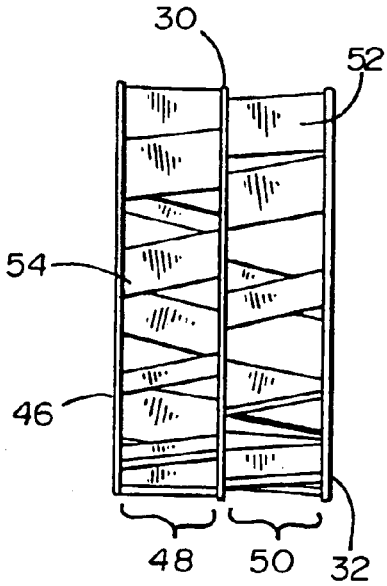
FIG. 14 is a side elevation view similar to FIG. 11 showing an impeller with mutually offset paddles.
Figure 15:
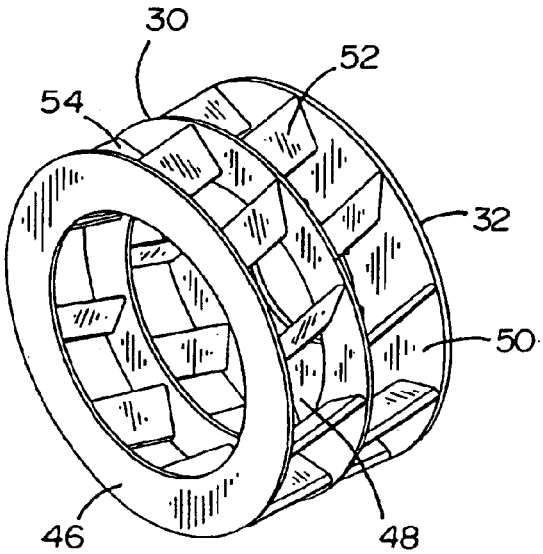
FIG. 15 is a perspective view similar to FIG. 12 showing an impeller having mutually offset paddles.

In another variation of the second embodiment, as illustrated in FIGS. 13–15, the impeller of FIGS. 10–12 is modified so that the first plurality of paddles 52 is located in a circumferentially offset relationship with the second plurality of paddles 54.

The impeller of the present invention is not limited to including only the additional ring 46 and the forward ring 30. Depending on the size of the drum and the food product to be fed into the impeller, the impeller of the present invention can include a series of additional rings, similarly arranged along the axis of the impeller and each in a similar fashion as the relationship between the forward ring 30 and the additional ring 46 as shown in FIGS. 10–12. In such an embodiment, it should be noted that each additional ring is axially spaced from one another in an opposite direction where the rear base plate 32 is located.

Alternatively, the impeller of the present invention can include a series of additional rings, similarly arranged along the axis of the impeller and each in a similar fashion as the relationship between the forward ring 30 and the additional ring 46 as shown in FIGS. 13–15.

In addition, the impeller may be arranged so that each end of a respective paddle of the second plurality of paddles that is located adjacent to the forward ring is positioned in a partially leading relationship relative to the end of the paddle of the second plurality of paddles that is located adjacent the additional ring with respect to an intended direction of the rotation of the impeller.

A variety of modifications can be made to the shape of the paddles. The size and shape of the paddles may be controlled depending upon the desired orientation of food products that will be carried by the impeller. The cross-section of the paddles may also be adapted to form elliptical, triangular cross-sections or other cross-sectional shapes that may be necessitated by the food product shape and desired, or by design constraints such as weight reduction and structural strength. Additionally, depending on the size and nature of the product, the number of paddles can be modified to accommodate a variety of food products.

The paddles may also be arranged so as to extend generally in a radial plane that is curved along its length to provide a degree of concavity presented in the direction of impeller rotation. Further modifications may include rounding, chamfering or squaring the edges of the paddles.

As mentioned above, although the improved impeller made in accordance with the present invention was illustrated and described in conjunction with a rotary food slicing machine for slicing food products into strips with a stationary slicing blade and cross-cut knives, it is possible to use the improved invention with any food product slicing machine in which food products are fed into a drum and urged around the periphery so as to be sliced by a slicing blade. In particular, the impeller may be used in conjunction with a rotary slicing machine having a rotating circular knife assembly whereby after the food product slabs emerge from the slicing blade, the slabs pass directly into the rotating circular knife assembly which slices the slabs into strips. In addition, other slicing and cutting apparatuses may be placed in series with a stationary slicing blade so as to produce a desired cut of the food products.

A variety of modifications and improvements to the impeller described herein are believed to be apparent to those skilled in the art. Accordingly, no limitation on the invention is intended by way of the foregoing description and drawings, except as specifically set forth in the appended claims.

What is claimed is:

1. An impeller arranged for placement in a rotary slicing machine, comprising:

a substantially circular base plate having an axis of rotation;

at least one ring having an axis generally parallel with the axis of rotation of the base plate;

a plurality of paddles extending between opposed radial surfaces of the base plate and the at least one ring in a circumferentially spaced relationship relative to the base plate;

each of the paddles extending at an identical and constant angle relative to the axis of rotation of the base plate, a trailing edge of each paddle being located adjacent the base plate in a trailing relationship relative to a leading edge of the paddle located adjacent to the at least one ring in an intended direction of rotation of the base plate;

each of the paddles oriented to extend at an angle relative to a radius of the base plate and the at least one ring, an inner edge of each paddle extending between the base plate and the at least one ring being located in a leading relationship relative to an outer edge extending between the base plate and the at least one ring of the paddle, the inner edge of each paddle defining a first corner with the leading edge and a second corner with the trailing edge of the paddle;

wherein a first radial distance is defined between the first corner and the axis of rotation of the base plate and a second radial distance is defined between the second corner and the axis of rotation of the base plate, the first radial distance being greater than the second radial distance.

2. The impeller according to claim 1, wherein the trailing and leading edges of the paddles are generally parallel to one another.

3. The impeller according to claim 1, wherein the inner and outer edges of the paddles are generally parallel to one another.

4. The impeller according to claim 1, wherein the inner and outer edges intersect the leading and trailing edges of each paddle at an oblique angle.

5. The impeller according to claim 1, wherein the outer edge of each paddle is oriented generally tangential to the periphery of the base plate and the at least one ring.

6. A rotary food slicing machine, comprising:

a non-rotating annular drum housing having a cylindrical axis and at least one axially extending slot formed therein;

at least one knife mounted on the housing in a position lining one side of the slot; and an impeller disposed within said drum, said impeller having an axis of rotation coincident with the cylindrical axis of the drum and rotatably driven about the axis of rotation of the drum, the impeller comprising a substantially circular base plate having an axis of rotation, at least one ring having an axis generally parallel with the axis of rotation of the base plate, and a plurality of paddles extending between opposed radial surfaces of the base plate and the at least one ring in a circumferentially spaced relationship relative to the base plate;

each of the paddles extending at an identical and constant angle relative to the axis of rotation of the base plate, a trailing edge of each paddle being located adjacent the base plate in a trailing relationship relative to a leading edge of the paddle located adjacent to the at least one ring in an intended direction of rotation of the base plate;

each of the paddles oriented to extend at an angle relative to a radius of the base plate and the at least one ring, an inner edge of each paddle extending between the base plate and the at least one ring being located in a leading relationship relative to an outer edge extending between the base plate and the at least one ring of the paddle, the inner edge of each paddle defining a first corner with the leading edge and a second corner with the trailing edge of the paddle;

wherein a first radial distance is defined between the first corner and the axis of rotation of the base plate and a second radial distance is defined between the second corner and the axis of rotation of the base plate, the first radial distance being greater than the second radial distance.

7. The impeller according to claim 6, wherein the trailing and leading edges of the paddles are generally parallel to one another.

8. The impeller according to claim 6, wherein the inner and outer edges of the paddles are generally parallel to one another.

9. The impeller according to claim 6, wherein the inner and outer edges intersect the leading and trailing edges of each paddle at an oblique angle.

10. The impeller according to claim 6, wherein the outer edge of each paddle is oriented generally tangential to the periphery of the base plate and the at least one ring.

* * * * *

UNITED STATES PATENT AND TRADEMARK OFFICE

CERTIFICATE OF CORRECTION

PATENT NO. : 6,883,411 B2
APPLICATION NO. : 09/828953
DATED : April 26, 2005
INVENTOR(S) : Paul E. Arrasmith It is certified that error appears in the above-identified patent and that said Letters Patent is hereby corrected as shown below:

Please correct the claims as follows: should read,

Col. 10 lines 14-16
7. The ~~impeller~~ machine according to claim 6, wherein the trailing and leading edges of the paddles are generally parallel to one another.

Col. 10 lines 17-19
8. The ~~impeller~~ machine according to claim 6, wherein the inner and outer edges of the paddles are generally parallel to one another.

Col. 10 lines 20-22
9. The ~~impeller~~ machine according to claim 6, wherein the inner and outer edges intersect the leading and trailing edges of each paddle at an oblique angle.

Col. 10 lines 23-25
10. The ~~impeller~~ machine according to claim 6, wherein the outer edge of each paddle is oriented generally tangential to the periphery of the base plate and the at least one ring.

Signed and Sealed this

Nineteenth Day of June, 2007

JON W. DUDAS
*Director of the United States Patent and Trademark Office*